US009419327B2

(12) United States Patent
Haridim et al.

(10) Patent No.: US 9,419,327 B2
(45) Date of Patent: Aug. 16, 2016

(54) SYSTEM FOR RADIATING RADIO FREQUENCY SIGNALS

(76) Inventors: Motti Haridim, Givat Zeev (IL); Michael Bank, Jerusalem (IL)

( * ) Notice: Subject to any disclaimer, the term of this patent is extended or adjusted under 35 U.S.C. 154(b) by 291 days.

(21) Appl. No.: 13/049,919

(22) Filed: Mar. 17, 2011

(65) Prior Publication Data

US 2011/0254747 A1 Oct. 20, 2011

Related U.S. Application Data

(60) Provisional application No. 61/315,059, filed on Mar. 18, 2010.

(51) Int. Cl.

| | |
|---|---|
| ***H01Q 1/00*** | (2006.01) |
| ***H01Q 1/24*** | (2006.01) |
| ***H01Q 9/16*** | (2006.01) |
| ***H01Q 9/30*** | (2006.01) |

(52) U.S. Cl.

CPC ..... *H01Q 1/243* (2013.01); *H01Q 9/16* (2013.01); *H01Q 9/30* (2013.01)

(58) Field of Classification Search

USPC ..... 343/702, 722, 846, 850, 860, 862

See application file for complete search history.

(56) References Cited

U.S. PATENT DOCUMENTS

| | | | | |
|---|---|---|---|---|
| 4,728,960 | A * | 3/1988 | Lo | 343/700 MS |
| 5,021,800 | A * | 6/1991 | Rilling | 343/820 |
| 5,087,922 | A * | 2/1992 | Tang et al. | 343/814 |
| 6,466,169 | B1 * | 10/2002 | Harrell et al. | 343/700 MS |
| 7,688,273 | B2 * | 3/2010 | Montgomery et al. | 343/820 |
| 2003/0151556 | A1 * | 8/2003 | Cohen | 343/700 MS |
| 2004/0150562 | A1 * | 8/2004 | Paun | H01Q 1/243 343/700 MS |
| 2006/0114079 | A1 * | 6/2006 | Cantrell | H01P 9/00 333/160 |
| 2007/0252774 | A1 * | 11/2007 | Qi et al. | 343/866 |
| 2009/0251380 | A1 * | 10/2009 | Kuramoto et al. | 343/843 |
| 2009/0274072 | A1 * | 11/2009 | Knox | H01Q 1/2225 370/278 |
| 2009/0318094 | A1 * | 12/2009 | Pros et al. | 455/75 |

* cited by examiner

*Primary Examiner* — Allyson Trail

(74) *Attorney, Agent, or Firm* — Henry M. Feiereisen LLC.

(57) ABSTRACT

A system that includes a phase shifter and a radiating element of an electrical circuit; wherein the phase shifter is arranged to: (a) receive, from a first lead of a feed line, a first signal that is a radio frequency (RF) signal; (b) delay the first RF signal by about 180 degrees to provide a delayed signal; and (c) provide the delayed signal to a first feeding point of the radiating element; wherein the radiating element further comprises a second feeding point that is arranged to receive from a second lead of the lead line a second signal that is a RF signal; wherein the delayed signal and the second signal are substantially in phase. The system can include or be an improved MB antenna.

9 Claims, 13 Drawing Sheets

SYSTEM FOR RADIATING RADIO FREQUENCY SIGNALS

RELATED APPLICATIONS

This application claims the priority of U.S. provisional patent 61/315,059, filing date Mar. 18, 2010 which is incorporated herein by reference.

FIELD OF THE INVENTION

The present invention relates generally to the field of radio frequency antennas and more particularly to linear antennas for implementation as internal antennas in different applications including mobile handsets.

BACKGROUND OF THE INVENTION

Among other properties, the antennas of portable handsets such as portable phones, portable digital assistance (PDA) and wireless notebook computers, are required to be of small size, efficient, omnidirectional, and installed inside the mobile phone which contains a PCB (printed circuit board) acting as a ground plane.

Monopole antennas installed vertically to a ground plane provide an antenna whose characteristics in terms of radiation pattern; input impedance, etc., are well suited for cellular and other mobile handsets. Consequently, this antenna has been widely used in portable phones, portable radios, cellular phones and personal communication systems. Modern portable phones and especially cellular phone handsets are size limited and use internal antennas. Hence, despite its advantages, the monopole antenna cannot be implemented in modern handsets.

A widely used antenna in modern portable handsets is PIFA (planar inverted F-antenna) which is compact and is mounted above the PCB of the phone handset, where the PCB acts as a ground plane. PIFA suffers from limitations such as a relatively large size including antenna height above the PCB, a relatively high radiation level in the undesired vertical direction, and strong influence of the user's hand and head.

Another solution is the recently proposed MB-1 antenna which is an internal antenna, implemented in parallel to the ground plane (PCB). This antenna consists of a ground plane, a straight line conductor (a "pole") and a phase shifting element, such as a delay line, used for phase shifting. The MB-1 antenna's characteristics are similar to those of conventional monopole antennas. However, this antenna requires a radiating element that is realized either as a wire held in parallel to the device's PCB or printed on a bare portion of the PCB.

SUMMARY OF THE INVENTION

A system may be provided and may be an antenna or may include an antenna. The system may include a phase shifter and a radiating element of an electrical circuit; wherein the phase shifter is arranged to: receive, from a first lead of a feed line, a first signal that is a radio frequency (RF) signal; delay the first signal by about 180 degrees to provide a delayed signal; and provide the delayed signal to a first feeding point of the radiating element; wherein the radiating element further comprises a second feeding point that is arranged to receive from a second lead of the lead line a second signal that is a RF signal; wherein the delayed signal and the second signal are substantially in phase.

Figure 1:
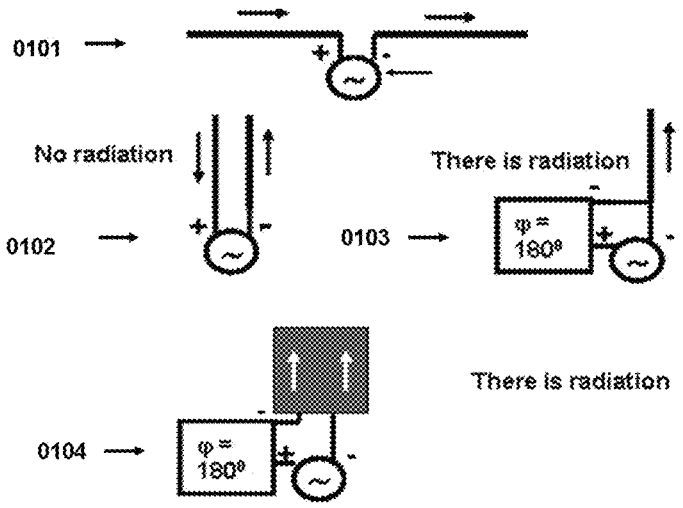
FIG. 1 illustrates currents that propagate through prior art antennas and an antenna according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

FIG. 1 shows the current directions in known conventional dipole (0101), in dipole whose arms are in parallel (0102), in MB-1 antenna, which allows for achieving monopole parameters in monopole construction (0103), and embedded enhanced MB antenna that is a single-arm dipole, which uses a PCB as a radiation element, according to an embodiment of the invention (0104).

Figure 2:
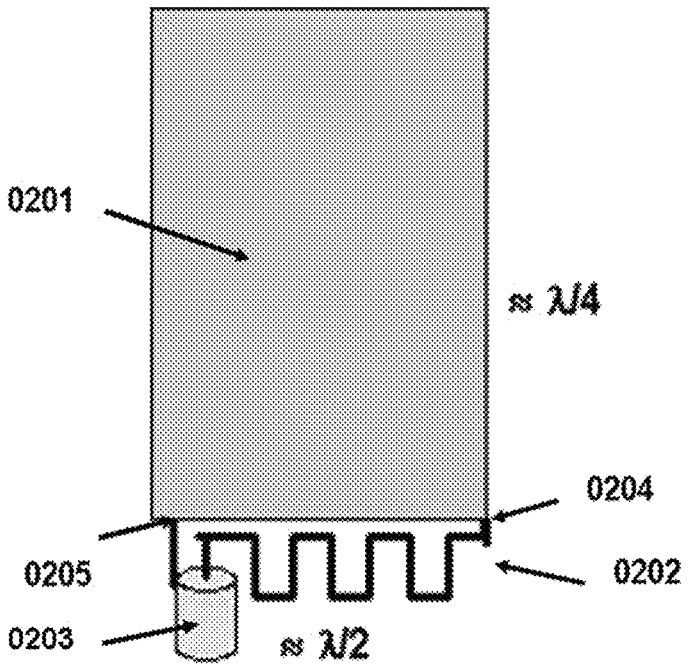
FIGS. 2, 3, 5, 6, 7, 10, 12 and 13 illustrate antennas according to various embodiments of the invention.

FIG. 2 is a simplified pictorial illustration of an embodiment of the MB antenna, where (0201) is PCB, 0202 is phase shifter (delay line), (0203) is the feed line, (204) and (205) are the feed points on the radiating plane.

Figure 3:
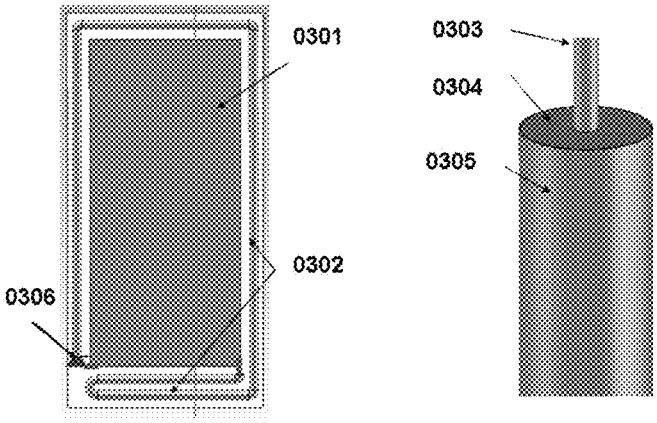

FIG. 3 illustrates an MB antenna that includes a phase shifter that is made of a coaxial line according to an embodiment of the invention; where near PCB (0301) is located coaxial cable (0302), which consists of a metallic core (0303), dielectric material (0304) and metallic screening envelope (0305); (0306) is signal source (feed line).

Figure 4:
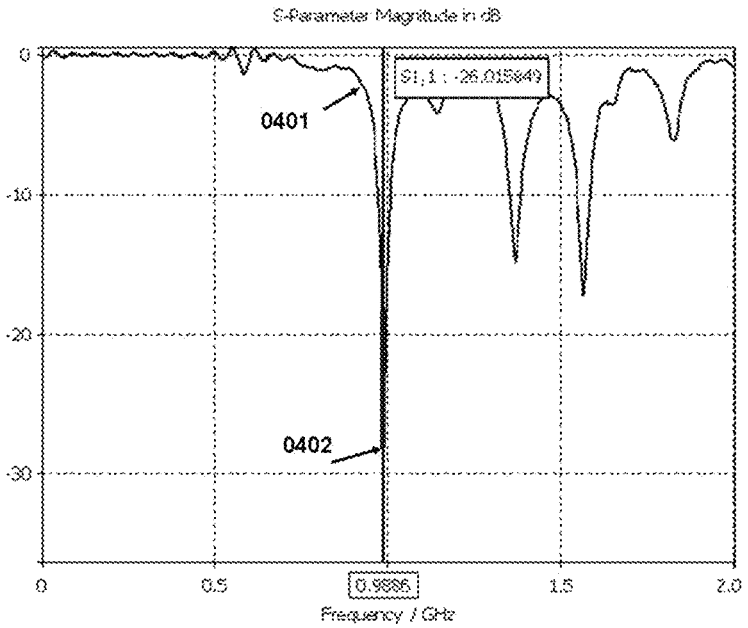
FIGS. 4, 8, 9 and 11 illustrate simulation results according to various embodiments of the invention.

FIG. 4 illustrates a S11 simulation of the radiation pattern of the antenna according to an embodiment of the invention; where (0401) shows a return loss curve, (0402) shows a return loss minimum of −28 dB indicative of good matching and resonance properties of the MB antenna The obtained values in this simulation are: Frequency 0.9885 GHz; Radiation efficiency 0.9877; Total efficiency 0.9849; Emax at distance 1 m with Uin=1V is 7.438 V/m; Gain 2.673 dB.

Figure 5:
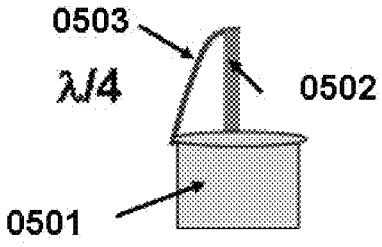

FIG. 5 illustrates current distribution in known conventional $\lambda/4$ monopole, where (0501) is source, (0502) is monopole and (0503) is current distribution.

Figure 6:
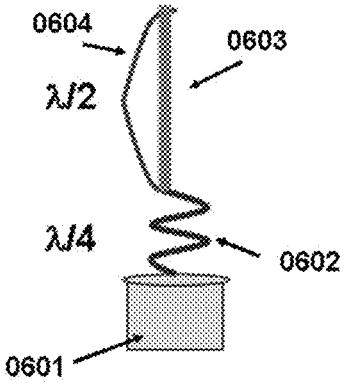

FIG. 6 illustrates current distribution in known $\lambda/2$ monopole, where (0601) is source, (0602) is $\lambda/4$ phase shifter (0603) is $\lambda/2$ monopole, (4) is current distribution.

Figure 7:
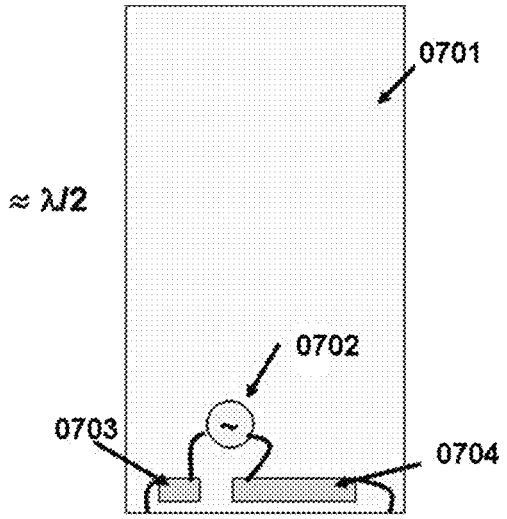

FIG. 7 illustrates construction of MB antenna for the higher cellular frequency around 2 GHz using a PCB of the same dimensions as for the lower cellular frequency, where (0701) is PCB, (0702) is signal source, (0703) is λ/4 phase shifter, (0704) is λ/2 phase shifter.

Figure 8:
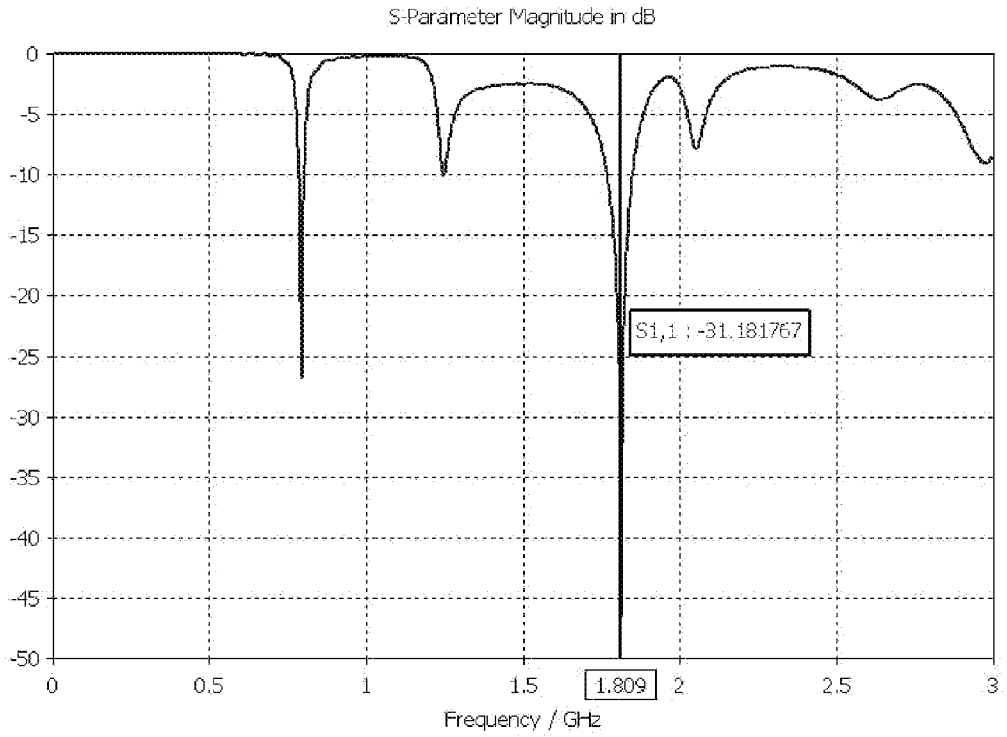

FIG. 8 illustrates S11 Simulation results on the MB antenna of FIG. 7 designed for the higher cellular frequency around 2 GHz on the same PCB as that of FIG. 2 designed for the lower cellular frequency.

Figure 9:
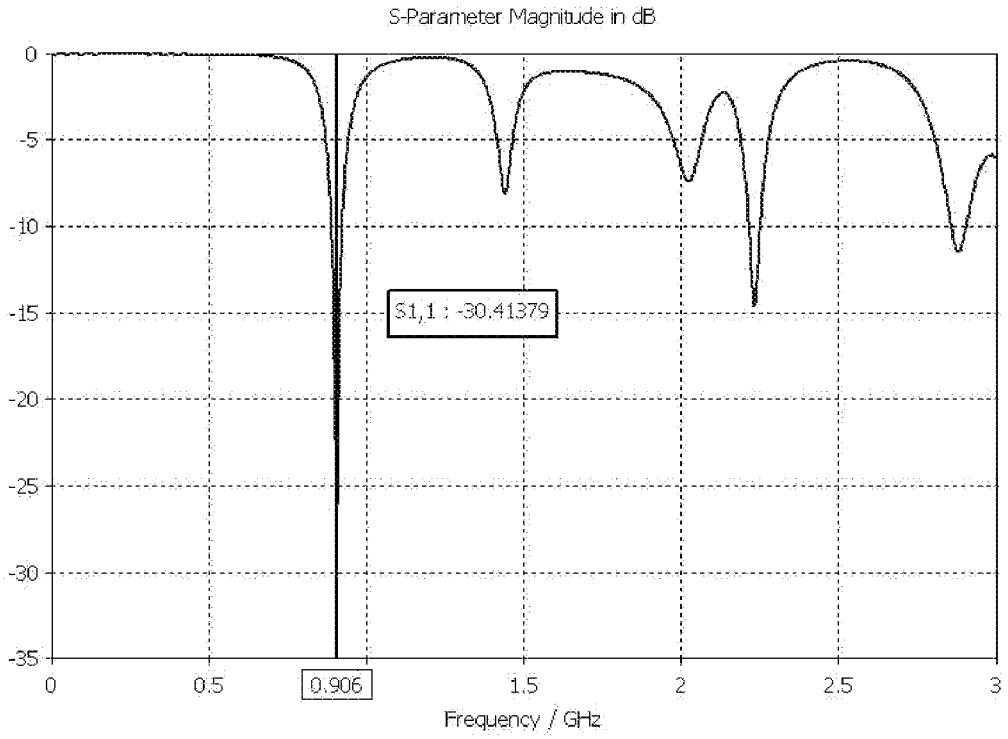

FIG. 9 illustrates S11 Simulation results on the antenna of FIG. 2 designed for the lower cellular frequency.

Figure 10:
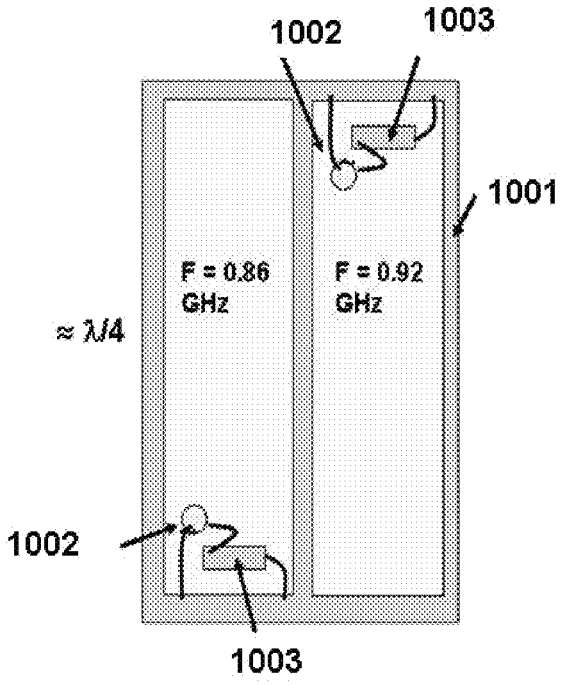

FIG. 10 shows a two-antenna structure providing for downlink and uplink frequencies, where (1001) is dielectric substrate, (1002) is source or receiver input, (1003) is λ/2 phase shifter.

Figure 11:
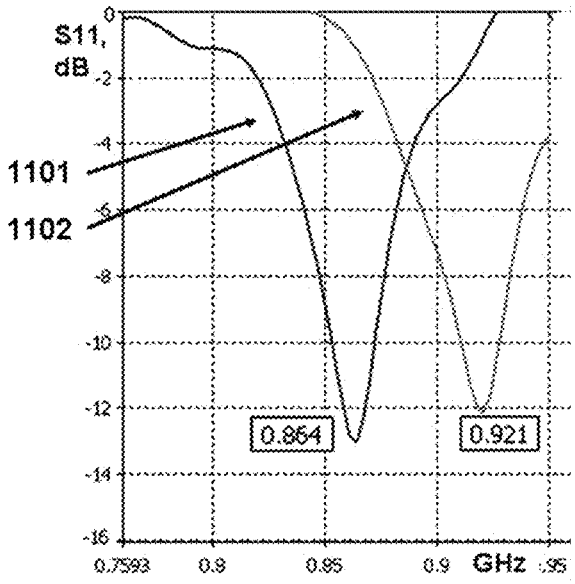

FIG. 11 illustrates S11 simulations results of the two-antenna structure, where (1101) corresponds to first antenna with central frequency 0.864 GHz and (1102) corresponds to second antenna with central frequency 0.921 GHz.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

As well-known the height of monopole antenna is half of that of dipole antenna. The monopole is more suitable for installing in small handset. However, dipole has superior parameters in comparison with monopole. The MB antenna uses an π/2 phase shifter to implement a single arm dipole, hence offering the advantages of both monopole and dipole.

A system that includes a single conductor linear antenna is provided. In this antenna the radiating elements (either the ground plane and the arm of the monopole or the two arms of a dipole)) are combined to a single radiating element (also referred to as the "radiating" plane).

The single conducting plane of this antenna acts as the whole radiating element. It is noted that the radiating element can be a part of an electrical circuit such as a printed circuit board. The radiating plane can be formed as it includes large conductors and can be even formed as a large plane. It is noted that other conducting elements of electrical circuit can be used as the radiating element. For example—power supply conductors can also be used—if they are large enough and of appropriate length, e.g. about one fourth of the central wavelength of a transmitted signal.

The radiation may take place by the "radiating" plane.

The antenna may include:

(i) a conducting ("radiating") plane, which can be realized as the device's PCB, that acts as ground plane;

(ii) a phase shifting element such as a delay line that is connected to one lead of the feed line. The two leads of the feed line are both connected to the "radiating" plane, at different points. The delay line can be realized by wire, a delay line chip (e.g. based on SAW—surface acoustic wave), coaxial cable or alternatively printed on a dielectric substrate, if available. Delay line can be realized on any side of the PCB or around the PCB; it could be printed or laid loosely above the PCB.

and (iii) a dielectric substrate, which is optional, either as the PCB's substrate, or for holding the "ground" plane and/or the delay line.

The delay line is used to make currents in the two conductors of the feed line in-phase, such that inside the radiating element (e.g. the PCB acting as ground) the currents produced by the two feed points flow in the same direction and their fields add up constructively.

The delay line should (i) be realized in a non-radiating shape, and (ii) its electric length should be designed such that the currents produced in different parts of the "radiating" plane are in-phase flowing in the same direction.

The electrical length of the "radiating" plane is preferably equal to one quarter of the operating wavelength (of the RF signal to be radiated) and the delay line is tuned to provide a phase shift of approximately 180 degree, for the center frequency of the transmitted signal.

The antenna may have a "zero pole", i.e., the "ground" plane is the sole radiating element of the antenna. However, the "radiating" plane contains the two poles of the antenna acting as a dipole. The inclusion of the PCB in any mobile handset can be utilized as the radiating element—thus reducing the size of the antenna.

Using a phase shifter (e.g. a delay line) of about 180 degree between the two leads of the feed line, the currents stemming from two separate feeding points on the "radiating" plane, flow in the same direction and hence the fields due to these currents add up.

According to an embodiment of the invention a system is provided. The system can be an antenna or can include the antenna and at least one other component. The system may include a phase shifter and a radiating element of an electrical circuit. The phase shifter is arranged to: receive, from a first lead of a feed line, a first signal that is a radio frequency (RF) signal; delay the first RF signal by about 180 degrees to provide a delayed signal; and provide the delayed signal to a first feeding point of the radiating element; wherein the radiating element further comprises a second feeding point that is arranged to receive from a second lead of the feed line a second signal that is a RF signal; wherein the delayed signal and the second signal are substantially in phase.

The system is well suited for use as an internal antenna in mobile handsets and other compact applications.

The first and second feeding points may be connected at a distance of ¼ of the radiating plane width from both edges.

The electrical circuit may be a printed circuit board.

The radiating element may be a ground plane of the PCB.

The phase shifter may be implemented by a crystal delay line like a CDM-Type LTCC.

The first and second feeding points may be arranged to provide the delayed signal and the second signal such that the delayed signal and the second signal induce currents that propagate along a same direction, and are in-phase The system may be a mobile phone, a smart-phone, a personal data accessory, a computer, a media player.

The electrical circuit may include a dielectric substrate that supports the radiating element.

The radiating element may be about one fourth of a first signal wavelength long.

The radiating element may be of an adjustable effective length; wherein an effective length of the radiating element is set in response to a wavelength of the first signal.

The phase shifter may be of an adjustable delay length; wherein a delay length of the delay line is set in response to a wavelength of the first signal.

The radiating element may be of an adjustable effective length and wherein the phase shifter is of an adjustable delay length; wherein an effective length of the radiating element and the delay length of the phase shifter is set in response to a wavelength of the first signal.

The system may include a switching circuit for changing an effective length of the radiating element in response to a wavelength of the first signal.

The phase shifter may include a delay line that comprises multiple pairs of segments, wherein each pair of segments comprises a first segment through which the first signal propagates at a first direction and a second segment through which the first signal propagates at a second direction that is substantially opposite to the first direction.

The phase shifter may include a delay line that comprises multiple segments that are shaped such as to reduce an aggregate transmission from the delay line.

The system may include the feed line.

Third generation cellular phone uses two frequency bands. One is near 1 GHz and second near 2 GHz. MB antenna allows solving this problem without parameters degradation. If the MB antenna is designed for 1 GHz, the PCB height will be approximately 75 mm. In case of 2 GHz this height of 75 mm corresponds to $\lambda/2$.

In case of conventional monopoles, increasing the height beyond the optimal value e.g. $\lambda/4$ leads to performance degradation. In order to avoid this, the known solution is to add a phase shifter at the feed (see FIG. 5). If the monopole height is $\lambda/2$, a $\lambda/4$ phase shifter must be used (see FIG. 6).

Using this idea it is possible to implement an MB antenna on a PCB of height $\lambda/2$. In order to get in-phase currents along the PCB one can use an additional phase shift of $\lambda/4$ (see FIG. 7). It is possible to toggle from ≈1 GHz to ≈2 GHz by switching between phase shifters. The S11 simulation of this double frequency antenna is shown in FIG. 8.

The obtained values in this of simulation are:

Frequency 0.906 GHz; Radiation efficiency 0.9972; Total efficiency 0.9963; Emax at distance 1 m with Uin=1V is 6.946 V/m; Gain 2.071 dB Frequency 1.8 GHz; Radiation efficiency 0.9974; Total efficiency 0.9868; Emax at distance 1 m with Uin=1V is 7.625 V/m; Gain 2.923 dB.

It is well known, that signal power at far field decreases as the frequency increases But in case of MB antenna power increases due to current increasing in antenna (see FIG. 7).

Cellular phones use different frequencies in downlink and in uplink. The maximal relative ($\Delta F/F_o$) frequency bandwidth in each link is 4.3%. High efficiency antenna can't widen frequency band without decreasing the antenna's efficiency. MB antenna does allows getting these two bands by using different phase shifters for two sub antennas (see FIG. 9). S11 simulations of these sub antennas are shown in FIG. 11.

The obtained values from the simulation are: at central frequency Total efficiency is 0.975. Frequency band, where minimal total efficiency is 0.7, equals 52 MHz or 6%. Radiation efficiency at all frequencies in this frequency band is near 1.

FIG. 2 shows one implementation of one embodiment an antenna in its general form. The components are actually integrated in a single module consisting of a radiating element 201 of a PCB, and a phase shifter 202 (e.g. a delay line), where the radiating element 201 receive a first signals from a first feeding point 21 and a delayed signal from a second feeding point 22. The signal is fed into the antenna 10 as an unbalanced feed. The grounded lead 15 of the feed line 16 is connected the first feeding point 21 and the signal lead 17 of the feed line 16 is connected to the second feeding point 22. The two feeding points 21 and 22 on the ground plane can be located at various positions on the ground plane to achieve different electrical and radiation properties, which may be desired in different applications. Examples include, both point on the same side, points on opposite sides, points on to perpendicular sides. The feed points should be apart from the two edges by ¼ of the PCB width.

The proposed antenna can be easily implemented in handsets which require internal antennas and are subject to space limitations such as the mobile phone handsets.

The main properties of the proposed antenna such as the radiation characteristics are similar to those of conventional monopoles and hence the proposed antenna is highly suitable for cellular handset applications.

The phase shifter can be implemented by various methods, subject to two requirements mentioned above: (1) a non radiating shape, and (2) a total electrical length introducing a 180 degree phase shift in the signal lead of the feed line. It may include a simple delay line whose electrical length is nearly $\lambda/2$ and it is folded in such a manner that no radiation is produced by this line, as shown in FIG. 3.

The phase shifter can be either printed on the same substrate of the "ground" plane, or alternatively implemented by a separate wire outside the substrate. Another method for implementation of the phase shifter is a coil, which can be implemented as a printed coil on a substrate or as a conventional coil made of a three-dimensional wire. Still another method for implementation of the delay line is a zigzag line.

The PCB of the handset, used for the electronic hardware of the phone, may act as the substrate and "ground" plane for the proposed antenna. In this case, the phase shifter can be printed on a certain area of the PCB provided that this area is a bare dielectric material.

Figure 12:
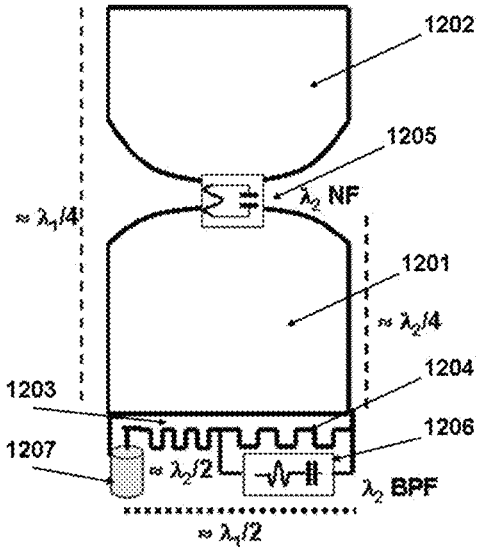

The proposed antenna can be designed for single-band or multi-band operation. FIG. 12 shows one possible scheme for a two-band version of the enhanced MB antenna. This antenna can work at two wavelengths $\lambda 1$ and $\lambda 2$, where $\lambda 1 > \lambda 2$. As it can be seen from FIG. 11, the PCB in this case is divided into two parts, which are connected via a notch (stop band) filter (NF) whose centre frequency corresponds to $\lambda 2$. The lower part of the PCB radiates only at wavelength $\lambda 2$. It is noted that the antenna can include more than two elements and that it may be adapted to operate in more than two different wavelengths.

For all other frequencies, except the stop band corresponding to $\lambda 2$, the two parts of PCB are practically unified and act as a single PCB. The phase shifting delay line is designed for $\lambda 1$.

Referring to FIGS. 12—(1201) is a first part of the PCB used for both frequency bands, (1202) is the second part of the PCB used at low frequency band, (1203) is phase shifter part for high frequency band, (1204) is phase shifter for low frequency band, (1205) is notch (rejection) filter that divides the two parts of the PCB at wavelength $\lambda 2$, (1206) is serial band pass filter that shortens the phase shifter at wavelength $\lambda 2$, (1207) is signal source.

As depicted in FIG. 12, it is possible to create a new band around $\lambda 2$ by means of a band pass filter (BPF) centered around $\lambda 2$, which is connected in parallel to a certain part of the delay line. The BPF can short-circuit this part of the delay line, and hence modify its effective length such that now the delay line corresponds to $\lambda 2$.

Figure 13:
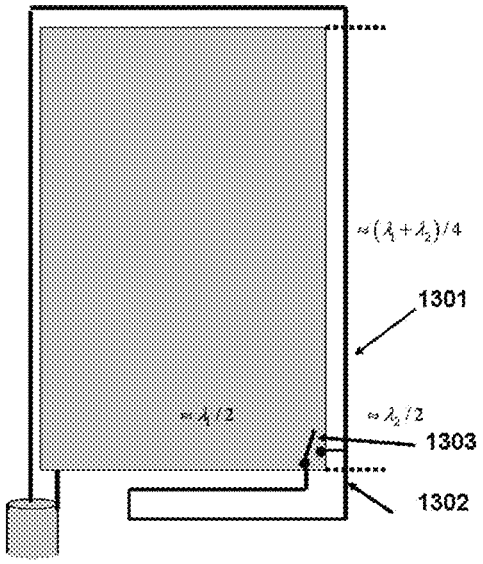

FIG. 13 presents another version of a two-band antenna, using a switching element. In this version, the PCB remains unchanged (not divided into different parts).

The length of the PCB is approximately equal to $(\lambda 1+\lambda 2)/4$. The delay line can work either in the first band or in the second band, depending on the switch position.

FIG. 13 illustrates one embodiment of the phase shifter for two band MB antenna, where (1301) is phase shifter (whole length from the feed line to the feed point) for low frequency band, (1302) is a portion at the end of the phase shifter that is short-circuited by the switch for high frequency band, (1303) is a switch for frequency band changing.

It is noted that a combination of the antennas illustrated in FIGS. 12 and 13 can be provided. For example—the radiating element can be of an adjustable effective length and the phase shifter can be of an adjustable delay length. The effective length of the radiating element and the delay length of the phase shifter is set in response to a wavelength of the first signal.

A method for transmission is provided. The method may use any of the mentioned above systems. The method includes receiving from a first lead of a feed line, a first signal that is a radio frequency (RF) signal; delaying the first RF signal by about 180 degrees to provide a delayed signal; providing the delayed signal to a first feeding point of the radiating element; receiving by a second feeding point of the radiating element and from a second lead of the lead line a second signal that is a RF signal; wherein the delayed signal and the second signal are substantially in phase; and radiating in response to the delayed signal and the second signal.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A transmission system, comprising:

a single signal source;

first and second leads extending from the single signal source and supplying a signal including two currents having phases which are offset from one another by 180 degrees;

a phase shifting element configured to shift a phase of one of the currents substantially by 180 degrees so that the one current obtains a same polarity as the other of the currents; and a single radiating element, wherein one of the first and second leads is connected with the phase shifting element, the phase shifting element is connected to the single radiating element, and the other of the first and second leads is connected directly to the single radiating element, and wherein, the one of the first and second leads connected with the phase shifting element supplies the one current to the phase shifting element so that a phase of the one current supplied by the one lead to the phase shifting element is changed by 180 degrees by the phase shifting element and then the one current with the phase changed by 180 degrees is supplied by the phase shifting element to the single radiating element, while the other current is supplied by the other of the first and second leads directly to the single radiating element, so that the single radiating element receives both currents in the same phase.

2. The transmission system according to claim 1, wherein the phase shifting element is a phase shifter which changes a phase of the signal supplied by the first lead by substantially 180 degrees.

3. The transmission system according to claim 1, wherein the phase shifting element is a line which has a length equal to one or odd number of half lengths of the signal supplied by the first lead.

4. The transmission system according to claim 1, wherein the single radiating element is constructed as a single antenna.

5. The transmission system according to claim 4, wherein the antenna is a single conductor linear antenna.

6. The transmission system according to claim 4, wherein the single antenna has a single conducting plane which acts as the whole radiating element.

7. The transmission system of claim 1, wherein the single radiating element is constructed as a printed circuit board.

8. A transmission system, consisting of:

a single signal source;

first and second leads extending from the single signal source and supplying a signal including two currents having phases which are offset from one another by 180 degrees;

a phase shifting element configured to shift a phase of one of the currents substantially by 180 degrees so that the one current obtains a same polarity as the other of the currents; and a single radiating element, wherein one of the first and second leads is connected with the phase shifting element, the phase shifting element is connected to the single radiating element, and the other of the first and second leads is connected directly to the single radiating element, and wherein the one of the first and second leads connected with the phase shifting element supplies the one current to the phase shifting element so that a phase of the one current supplied by the one lead to the phase shifting element is changed by 180 degrees by the phase shifting element and then the one current with the phase changed by 180 degrees is supplied by the phase shifting element to the single radiating element, while the other current is supplied by the other of the first and second leads directly to the single radiating element, so that the single radiating element receives both currents in the same phase.

9. An antenna, comprising first and second leads extending from a single signal source and supplying a signal including two currents having phases which are offset from one another by 180 degrees;

a phase shifting element configured to shift a phase of one of the currents substantially by 180 degrees so that the one current obtains a same polarity as the other of the currents; and a single radiating element, wherein one of the first and second leads is connected with the phase shifting element, the phase shifting element is connected to the single radiating element, and the other of the first and second leads is connected directly to the single radiating element, and wherein the one of the first and second leads connected with the phase shifting element supplies the one current to the phase shifting element so that a phase of the one current supplied by the one first lead to the phase shifting element is changed by 180 degrees by the phase shifting element and then the one current with the phase changed by 180 degrees is supplied by the phase shifting element to the single radiating element, while the other current is supplied by the other of the first and second leads directly to the single radiating element, so that the single radiating element receives both currents in the same phase.

* * * * *